US009708856B2

(12) United States Patent
Hall et al.

(10) Patent No.: US 9,708,856 B2
(45) **Date of Patent: *Jul. 18, 2017**

(54) DOWNHOLE DRILL BIT

(71) Applicant: Schlumberger Technology Corporation, Sugar Land, TX (US)

(72) Inventors: David R. Hall, Provo, UT (US); John D. Bailey, Spanish Fork, UT (US); Ronald B. Crockett, Payson, UT (US)

(73) Assignee: SMITH INTERNATIONAL, INC., Houston, TX (US)

( * ) Notice: Subject to any disclaimer, the term of this patent is extended or adjusted under 35 U.S.C. 154(b) by 59 days.

This patent is subject to a terminal disclaimer.

(21) Appl. No.: 14/717,567

(22) Filed: May 20, 2015

(65) Prior Publication Data

US 2015/0252624 A1 Sep. 10, 2015

Related U.S. Application Data

(63) Continuation of application No. 14/089,385, filed on Nov. 25, 2013, now Pat. No. 9,051,795, which is a (Continued)

(51) Int. Cl.
*E21B 10/43* (2006.01)
*E21B 10/55* (2006.01)
(Continued)

(52) U.S. Cl.
CPC ..... *E21B 10/55* (2013.01); *E21B 10/43* (2013.01); *E21B 10/5673* (2013.01);
(Continued)

(58) Field of Classification Search
CPC ..... E21B 10/43; E21B 10/5735
See application file for complete search history.

(56) References Cited

U.S. PATENT DOCUMENTS 4,315 A 12/1845 Hemming
37,223 A 12/1862 Fosdick
(Continued)

FOREIGN PATENT DOCUMENTS

DE 2442146 A1 3/1976
DE 3307910 A1 9/1984
(Continued)

OTHER PUBLICATIONS

SME Mining Engineering Handbook (pp. 691-692) 1992.
(Continued)

*Primary Examiner* — John Kreck

(57) ABSTRACT

A downhole cutting tool may include a tool body; a plurality of blades extending from the tool body; a first blade comprising at least one pointed cutting element thereon, the at least one pointed cutting element comprising a first polycrystalline diamond material on a first carbide substrate, the first polycrystalline diamond material extending away from the first carbide substrate to terminate in a substantially pointed geometry opposite the first carbide substrate; a second blade comprising at least one shear cutting element, the at least one shear cutting element comprising a second polycrystalline diamond material on a second carbide substrate, the second polycrystalline diamond material forming a planar cutting surface opposite the substrate; wherein, when the first blade and the second blade are superimposed on each other, a central axis of the at least one pointed cutting element is offset from a central axis of the at least one shear cutting element.

20 Claims, 10 Drawing Sheets

Related U.S. Application Data continuation of application No. 11/861,641, filed on Sep. 26, 2007, now Pat. No. 8,590,644, which is a continuation-in-part of application No. 11/829,577, filed on Jul. 27, 2007, now Pat. No. 8,622,155, which is a continuation-in-part of application No. 11/766,975, filed on Jun. 22, 2007, now Pat. No. 8,122,980, said application No. 11/861,641 is a continuation-in-part of application No. 11/774,227, filed on Jul. 6, 2007, now Pat. No. 7,669,938, which is a continuation-in-part of application No. 11/773,271, filed on Jul. 3, 2007, now Pat. No. 7,997,661, which is a continuation-in-part of application No. 11/766,903, filed on Jun. 22, 2007, now abandoned, which is a continuation of application No. 11/766,865, filed on Jun. 22, 2007, now abandoned, which is a continuation-in-part of application No. 11/742,304, filed on Apr. 30, 2007, now Pat. No. 7,475,948, which is a continuation of application No. 11/742,261, filed on Apr. 30, 2007, now Pat. No. 7,469,971, which is a continuation-in-part of application No. 11/464,008, filed on Aug. 11, 2006, now Pat. No. 7,338,135, which is a continuation-in-part of application No. 11/463,998, filed on Aug. 11, 2006, now Pat. No. 7,384,105, which is a continuation-in-part of application No. 11/463,990, filed on Aug. 11, 2006, now Pat. No. 7,320,505, which is a continuation-in-part of application No. 11/463,975, filed on Aug. 11, 2006, now Pat. No. 7,445,294, which is a continuation-in-part of application No. 11/463,962, filed on Aug. 11, 2006, now Pat. No. 7,413,256, said application No. 11/861,641 is a continuation-in-part of application No. 11/695,672, filed on Apr. 3, 2007, now Pat. No. 7,396,086, which is a continuation-in-part of application No. 11/686,831, filed on Mar. 15, 2007, now Pat. No. 7,568,770.

(51) Int. Cl.

| | |
|---|---|
| ***E21B 10/573*** | (2006.01) |
| ***E21B 10/567*** | (2006.01) |
| *E21B 10/42* | (2006.01) |
| *E21B 10/54* | (2006.01) |

(52) U.S. Cl.

CPC .... *E21B 10/5735* (2013.01); *E21B 2010/425* (2013.01); *E21B 2010/545* (2013.01)

(56) References Cited

U.S. PATENT DOCUMENTS

| | | | |
|---|---|---|---|
| 465,103 | A | 12/1891 | Wegner |
| 616,118 | A | 12/1898 | Kunhe |
| 946,060 | A | 1/1910 | Looker |
| 1,116,154 | A | 11/1914 | Stowers |
| 1,183,630 | A | 5/1916 | Bryson |
| 1,189,560 | A | 7/1916 | Gondos |
| 1,360,908 | A | 11/1920 | Everson |
| 1,387,733 | A | 8/1921 | Midgett |
| 1,460,671 | A | 7/1923 | Hebsacker |
| 1,544,757 | A | 7/1925 | Hufford et al. |
| 1,821,474 | A | 9/1931 | Mercer |
| 1,879,177 | A | 9/1932 | Gault |
| 2,004,315 | A | 6/1935 | Fean |
| 2,054,255 | A | 9/1936 | Howard |
| 2,064,255 | A | 12/1936 | Garfield |
| 2,121,202 | A | 6/1938 | Kilgore |
| 2,124,438 | A | 7/1938 | Struk et al. |
| 2,169,223 | A | 8/1939 | Christian |
| 2,218,130 | A | 10/1940 | Court |
| 2,320,136 | A | 5/1943 | Kammerer |
| 2,466,991 | A | 4/1949 | Kammerer |
| 2,540,464 | A | 2/1951 | Stokes |
| 2,545,036 | A | 3/1951 | Kammerer |
| 2,755,071 | A | 7/1956 | Kammerer |
| 2,776,819 | A | 1/1957 | Brown |
| 2,819,043 | A | 1/1958 | Henderson |
| 2,838,284 | A | 6/1958 | Austin |
| 2,894,722 | A | 7/1959 | Buttolph |
| 2,901,223 | A | 8/1959 | Scott |
| 2,963,102 | A | 12/1960 | Smith |
| 3,135,341 | A | 6/1964 | Ritter |
| 3,254,392 | A | 6/1966 | Novkov |
| 3,294,186 | A | 12/1966 | Buell |
| 3,301,339 | A | 1/1967 | Pennebaker, Jr. |
| 3,342,531 | A | 9/1967 | Krekeler |
| 3,342,532 | A | 9/1967 | Krekeler |
| 3,379,264 | A | 4/1968 | Cox |
| 3,397,012 | A | 8/1968 | Krekeler |
| 3,429,390 | A | 2/1969 | Bennett |
| 3,493,165 | A | 2/1970 | Schonfeld |
| 3,512,838 | A | 5/1970 | Kniff |
| 3,583,504 | A | 6/1971 | Aalund |
| 3,626,775 | A | 12/1971 | Gentry |
| 3,650,565 | A | 3/1972 | Kniff |
| 3,655,244 | A | 4/1972 | Swisher |
| 3,745,396 | A | 7/1973 | Quintal et al. |
| 3,745,623 | A | 7/1973 | Wentorf, Jr. et al. |
| 3,746,396 | A | 7/1973 | Radd |
| 3,764,493 | A | 10/1973 | Rosar |
| 3,765,493 | A | 10/1973 | Rosar et al. |
| 3,800,891 | A | 4/1974 | White et al. |
| 3,807,804 | A | 4/1974 | Kniff |
| 3,820,848 | A | 6/1974 | Kniff |
| 3,821,993 | A | 7/1974 | Kniff |
| 3,830,321 | A | 8/1974 | McKenry et al. |
| 3,932,952 | A | 1/1976 | Helton et al. |
| 3,942,838 | A | 3/1976 | Bailey et al. |
| 3,945,681 | A | 3/1976 | White |
| 3,955,635 | A | 5/1976 | Skidmore |
| 3,957,307 | A | 5/1976 | Varda |
| 3,960,223 | A | 6/1976 | Kleine |
| 4,005,914 | A | 2/1977 | Newman |
| 4,006,936 | A | 2/1977 | Crabiel |
| 4,081,042 | A | 3/1978 | Johnson et al. |
| 4,096,917 | A | 6/1978 | Harris |
| 4,098,362 | A | 7/1978 | Bonnice |
| 4,106,577 | A | 8/1978 | Summers |
| 4,109,737 | A | 8/1978 | Bovenkerk |
| RE29,900 | E | 2/1979 | Kniff |
| 4,140,004 | A | 2/1979 | Smith et al. |
| 4,156,329 | A | 5/1979 | Daniels et al. |
| 4,176,723 | A | 12/1979 | Arceneaux |
| 4,199,035 | A | 4/1980 | Thompson |
| 4,201,421 | A | 5/1980 | Den Besten et al. |
| 4,211,508 | A | 7/1980 | Dill et al. |
| 4,224,380 | A | 9/1980 | Bovenkerk et al. |
| 4,247,150 | A | 1/1981 | Wrulich et al. |
| 4,251,109 | A | 2/1981 | Roepke |
| 4,253,533 | A | 3/1981 | Baker, III |
| 4,268,089 | A | 5/1981 | Spence et al. |
| 4,277,106 | A | 7/1981 | Sahley |
| 4,280,573 | A | 7/1981 | Sudnishnikov et al. |
| 4,289,211 | A | 9/1981 | Lumen |
| 4,304,312 | A | 12/1981 | Larsson |
| 4,307,786 | A | 12/1981 | Evans |
| D264,217 | S | 5/1982 | Prause et al. |
| 4,333,902 | A | 6/1982 | Hara |
| 4,333,986 | A | 6/1982 | Tsuji et al. |
| 4,337,980 | A | 7/1982 | Krekeler |
| 4,390,992 | A | 6/1983 | Judd |
| 4,397,361 | A | 8/1983 | Langford, Jr. |
| 4,397,362 | A | 8/1983 | Dice et al. |
| 4,412,980 | A | 11/1983 | Tsuji et al. |
| 4,416,339 | A | 11/1983 | Baker et al. |
| 4,425,315 | A | 1/1984 | Tsuji et al. |
| 4,439,250 | A | 3/1984 | Acharya et al. |
| 4,445,580 | A | 5/1984 | Sahley |
| 4,448,269 | A | 5/1984 | Ishikawa et al. |

(56) References Cited

U.S. PATENT DOCUMENTS 4,465,221 A 8/1984 Schmidt
4,481,016 A 11/1984 Campbell et al.
4,484,644 A 11/1984 Cook et al.
4,484,783 A 11/1984 Emmerich
4,489,986 A 12/1984 Dziak
4,497,520 A 2/1985 Ojanen
4,499,795 A 2/1985 Radtke
4,525,178 A 6/1985 Hall
4,531,592 A 7/1985 Hayatdavoudi
4,535,853 A 8/1985 Ippolito et al.
4,537,448 A 8/1985 Ketterer
4,538,691 A 9/1985 Dennis
4,542,942 A 9/1985 Zitz et al.
4,566,545 A 1/1986 Story et al.
4,573,744 A 3/1986 Clemmow et al.
4,574,895 A 3/1986 Dolezal et al.
4,583,786 A 4/1986 Thorpe et al.
4,599,731 A 7/1986 Ware et al.
4,604,106 A 8/1986 Hall
4,627,503 A 12/1986 Horton
4,627,665 A 12/1986 Ewing et al.
4,636,253 A 1/1987 Nakai et al.
4,636,353 A 1/1987 Seon et al.
4,640,374 A 2/1987 Dennis
4,647,111 A 3/1987 Bronder et al.
4,647,546 A 3/1987 Hall, Jr. et al.
4,650,776 A 3/1987 Cerceau et al.
4,655,508 A 4/1987 Tomlinson
4,657,308 A 4/1987 Clapham
4,660,890 A 4/1987 Mills
4,662,348 A 5/1987 Hall et al.
4,664,705 A 5/1987 Horton et al.
4,678,237 A 7/1987 Collin
4,682,987 A 7/1987 Brady et al.
4,684,176 A 8/1987 Den Besten et al.
4,688,856 A 8/1987 Elfgen
4,690,691 A 9/1987 Komanduri
4,694,918 A 9/1987 Hall
4,702,525 A 10/1987 Sollami et al.
4,725,098 A 2/1988 Beach
4,726,718 A 2/1988 Meskin et al.
4,728,153 A 3/1988 Ojanen et al.
4,729,440 A 3/1988 Hall
4,729,441 A 3/1988 Peetz et al.
4,729,603 A 3/1988 Elfgen
4,736,533 A 4/1988 May et al.
4,746,379 A 5/1988 Rabinkin
4,765,419 A 8/1988 Scholz et al.
4,765,686 A 8/1988 Adams
4,765,687 A 8/1988 Parrott
4,776,862 A 10/1988 Wiand
4,798,026 A 1/1989 Cerceau
4,804,231 A 2/1989 Buljan et al.
4,811,801 A 3/1989 Salesky et al.
4,836,614 A 6/1989 Ojanen
4,850,649 A 7/1989 Beach et al.
4,852,672 A 8/1989 Behrens
4,880,154 A 11/1989 Tank
4,889,017 A 12/1989 Fuller et al.
4,893,875 A 1/1990 Lonn et al.
D305,871 S 2/1990 Geiger
4,921,310 A 5/1990 Hedlund et al.
D308,683 S 6/1990 Meyers
4,932,723 A 6/1990 Mills
4,940,099 A 7/1990 Deane et al.
4,940,288 A 7/1990 Stiffler et al.
4,944,559 A 7/1990 Sionnet et al.
4,944,772 A 7/1990 Cho
4,951,762 A 8/1990 Lundell
4,956,238 A 9/1990 Griffin
4,962,822 A 10/1990 Pascale
4,981,184 A 1/1991 Knowlton et al.
5,007,685 A 4/1991 Beach et al.
5,009,273 A 4/1991 Grabinski
5,011,515 A 4/1991 Frushour
5,027,914 A 7/1991 Wilson
5,038,873 A 8/1991 Jurgens
D324,056 S 2/1992 Frazee
D324,226 S 2/1992 Frazee
5,088,797 A 2/1992 O'Neill
5,092,310 A 3/1992 Walen et al.
5,106,166 A 4/1992 O'Neill
5,112,165 A 5/1992 Hedlund et al.
5,119,714 A 6/1992 Scott et al.
5,119,892 A 6/1992 Clegg et al.
5,120,327 A 6/1992 Dennis
5,141,063 A 8/1992 Quesenbury
5,141,289 A 8/1992 Stiffler
D329,809 S 9/1992 Bloomfield
5,154,245 A 10/1992 Waldenstrom et al.
5,186,268 A 2/1993 Clegg
5,186,892 A 2/1993 Pope
5,222,566 A 6/1993 Taylor et al.
5,235,961 A 8/1993 McShannon
5,248,006 A 9/1993 Scott et al.
5,251,964 A 10/1993 Ojanen
5,255,749 A 10/1993 Bumpurs et al.
5,261,499 A 11/1993 Grubb
5,265,682 A 11/1993 Russell et al.
D342,268 S 12/1993 Meyer
5,303,984 A 4/1994 Ojanen
5,304,342 A 4/1994 Hall, Jr. et al.
5,319,855 A 6/1994 Beevers et al.
5,332,051 A 7/1994 Knowlton
5,332,348 A 7/1994 Lemelson
5,351,770 A 10/1994 Cawthorne et al.
5,361,859 A 11/1994 Tibbitts
5,364,319 A 11/1994 Boll et al.
D357,485 S 4/1995 Mattsson et al.
5,410,303 A 4/1995 Comeau et al.
5,415,462 A 5/1995 Massa
5,417,292 A 5/1995 Polakoff
5,417,475 A 5/1995 Graham et al.
5,423,389 A 6/1995 Warren et al.
5,447,208 A 9/1995 Lund et al.
5,494,477 A 2/1996 Flood et al.
5,503,463 A 4/1996 Ojanen
5,507,357 A 4/1996 Hult et al.
D371,374 S 7/1996 Fischer et al.
5,533,582 A 7/1996 Tibbitts
5,535,839 A 7/1996 Brady
5,542,993 A 8/1996 Rabinkin
5,544,713 A 8/1996 Dennis
5,560,440 A 10/1996 Tibbitts
5,568,838 A 10/1996 Struthers et al.
5,653,300 A 8/1997 Lund et al.
5,655,614 A 8/1997 Azar
5,662,720 A 9/1997 O'Tighearnaigh
5,678,644 A 10/1997 Fielder
5,709,279 A 1/1998 Dennis
5,720,528 A 2/1998 Ritchey
5,725,283 A 3/1998 O'Neill
5,730,502 A 3/1998 Montgomery, Jr.
5,732,784 A 3/1998 Nelson
5,738,415 A 4/1998 Parrott
5,738,698 A 4/1998 Kapoor et al.
5,794,728 A 8/1998 Palmberg
5,811,944 A 9/1998 Sampayan et al.
5,823,632 A 10/1998 Burkett
5,837,071 A 11/1998 Andersson et al.
5,845,547 A 12/1998 Sollami
5,848,657 A 12/1998 Flood et al.
5,871,060 A 2/1999 Jensen et al.
5,875,862 A 3/1999 Jurewicz et al.
5,884,979 A 3/1999 Latham
5,890,552 A 4/1999 Scott et al.
5,896,938 A 4/1999 Moeny et al.
5,914,055 A 6/1999 Roberts et al.
5,934,542 A 8/1999 Nakamura et al.
5,935,718 A 8/1999 Demo et al.
5,944,129 A 8/1999 Jensen
5,947,215 A 9/1999 Lundell
5,950,743 A 9/1999 Cox
5,957,223 A 9/1999 Doster et al.

(56) References Cited

U.S. PATENT DOCUMENTS

| | | | |
|---|---|---|---|
| 5,957,225 | A | 9/1999 | Sinor |
| 5,967,247 | A | 10/1999 | Pessier |
| 5,967,250 | A | 10/1999 | Lund et al. |
| 5,979,571 | A | 11/1999 | Scott et al. |
| 5,992,405 | A | 11/1999 | Sollami |
| 5,992,547 | A | 11/1999 | Caraway et al. |
| 5,992,548 | A | 11/1999 | Silva et al. |
| 6,000,483 | A | 12/1999 | Jurewicz et al. |
| 6,003,623 | A | 12/1999 | Miess |
| 6,006,846 | A | 12/1999 | Tibbitts et al. |
| 6,018,729 | A | 1/2000 | Zacharia et al. |
| 6,019,434 | A | 2/2000 | Emmerich |
| 6,021,859 | A | 2/2000 | Tibbitts et al. |
| 6,039,131 | A | 3/2000 | Beaton |
| 6,041,875 | A | 3/2000 | Rai et al. |
| 6,044,920 | A | 4/2000 | Massa et al. |
| 6,051,079 | A | 4/2000 | Andersson et al. |
| 6,056,911 | A | 5/2000 | Griffin |
| 6,059,054 | A | 5/2000 | Portwood et al. |
| 6,065,552 | A | 5/2000 | Scott et al. |
| 6,068,072 | A | 5/2000 | Besson et al. |
| 6,068,913 | A | 5/2000 | Cho et al. |
| 6,095,262 | A | 8/2000 | Chen |
| 6,098,730 | A | 8/2000 | Scott et al. |
| 6,102,486 | A | 8/2000 | Briese |
| 6,109,377 | A | 8/2000 | Massa et al. |
| 6,113,195 | A | 9/2000 | Mercier et al. |
| 6,131,675 | A | 10/2000 | Anderson |
| 6,150,822 | A | 11/2000 | Hong et al. |
| 6,170,917 | B1 | 1/2001 | Heinrich et al. |
| 6,186,251 | B1 | 2/2001 | Butcher |
| 6,193,770 | B1 | 2/2001 | Sung |
| 6,196,340 | B1 | 3/2001 | Jensen et al. |
| 6,196,636 | B1 | 3/2001 | Mills et al. |
| 6,196,910 | B1 | 3/2001 | Johnson et al. |
| 6,199,645 | B1 | 3/2001 | Anderson et al. |
| 6,199,956 | B1 | 3/2001 | Kammerer |
| 6,202,761 | B1 | 3/2001 | Forney |
| 6,213,226 | B1 | 4/2001 | Eppink et al. |
| 6,216,805 | B1 | 4/2001 | Lays et al. |
| 6,220,375 | B1 | 4/2001 | Butcher et al. |
| 6,220,376 | B1 | 4/2001 | Lundell |
| 6,223,824 | B1 | 5/2001 | Moyes |
| 6,223,974 | B1 | 5/2001 | Unde |
| 6,257,673 | B1 | 7/2001 | Markham et al. |
| 6,258,139 | B1 | 7/2001 | Jensen |
| 6,260,639 | B1 | 7/2001 | Yong et al. |
| 6,269,893 | B1 | 8/2001 | Beaton et al. |
| 6,270,165 | B1 | 8/2001 | Peay |
| 6,272,748 | B1 | 8/2001 | Smyth |
| 6,290,007 | B2 | 9/2001 | Beuershausen et al. |
| 6,290,008 | B1 | 9/2001 | Portwood et al. |
| 6,296,069 | B1 | 10/2001 | Lamine et al. |
| 6,302,224 | B1 | 10/2001 | Sherwood, Jr. |
| 6,302,225 | B1 | 10/2001 | Yoshida et al. |
| 6,315,065 | B1 | 11/2001 | Yong et al. |
| 6,332,503 | B1 | 12/2001 | Pessier et al. |
| 6,340,064 | B2 | 1/2002 | Fielder et al. |
| 6,341,823 | B1 | 1/2002 | Sollami |
| 6,354,771 | B1 | 3/2002 | Bauschulte et al. |
| 6,357,832 | B1 | 3/2002 | Sollami |
| 6,364,034 | B1 | 4/2002 | Schoeffler |
| 6,364,420 | B1 | 4/2002 | Sollami |
| 6,371,567 | B1 | 4/2002 | Sollami |
| 6,375,272 | B1 | 4/2002 | Ojanen |
| 6,375,706 | B2 | 4/2002 | Kembaiyan et al. |
| 6,394,200 | B1 | 5/2002 | Watson et al. |
| 6,408,052 | B1 | 6/2002 | McGeoch |
| 6,408,959 | B2 | 6/2002 | Bertagnolli et al. |
| 6,412,560 | B1 | 7/2002 | Bernat |
| 6,419,278 | B1 | 7/2002 | Cunningham |
| 6,424,919 | B1 | 7/2002 | Moran et al. |
| 6,429,398 | B1 | 8/2002 | Legoupil et al. |
| 6,435,287 | B2 | 8/2002 | Estes |
| 6,439,326 | B1 | 8/2002 | Huang et al. |
| 6,460,637 | B1 | 10/2002 | Siracki et al. |
| 6,468,368 | B1 | 10/2002 | Merrick et al. |
| 6,474,425 | B1 | 11/2002 | Truax et al. |
| 6,478,383 | B1 | 11/2002 | Ojanen et al. |
| 6,481,803 | B2 | 11/2002 | Ritchey |
| 6,484,825 | B2 | 11/2002 | Watson et al. |
| 6,484,826 | B1 | 11/2002 | Anderson et al. |
| 6,499,547 | B2 | 12/2002 | Scott et al. |
| 6,508,318 | B1 | 1/2003 | Linden et al. |
| 6,508,516 | B1 | 1/2003 | Kammerer |
| 6,510,906 | B1 | 1/2003 | Richert et al. |
| 6,513,606 | B1 | 2/2003 | Krueger |
| 6,516,293 | B1 | 2/2003 | Huang et al. |
| 6,517,902 | B2 | 2/2003 | Drake et al. |
| 6,533,050 | B2 | 3/2003 | Molloy |
| 6,561,293 | B2 | 5/2003 | Minikus et al. |
| 6,562,462 | B2 | 5/2003 | Griffin et al. |
| RE38,151 | E | 6/2003 | Penkunas et al. |
| D477,225 | S | 7/2003 | Pinnavaia |
| 6,585,326 | B2 | 7/2003 | Sollami |
| 6,585,327 | B2 | 7/2003 | Sollami |
| 6,592,985 | B2 | 7/2003 | Griffin et al. |
| 6,594,881 | B2 | 7/2003 | Tibbitts |
| 6,596,225 | B1 | 7/2003 | Pope et al. |
| 6,601,454 | B1 | 8/2003 | Botnan |
| 6,601,662 | B2 | 8/2003 | Matthias et al. |
| 6,622,803 | B2 | 9/2003 | Harvey et al. |
| 6,644,755 | B1 | 11/2003 | Kammerer |
| 6,659,206 | B2 | 12/2003 | Liang et al. |
| 6,668,949 | B1 | 12/2003 | Rives |
| 6,672,406 | B2 | 1/2004 | Beuershausen |
| 6,685,273 | B1 | 2/2004 | Sollami |
| 6,692,083 | B2 | 2/2004 | Latham |
| 6,702,393 | B2 | 3/2004 | Mercier |
| 6,709,065 | B2 | 3/2004 | Peay et al. |
| 6,711,060 | B2 | 3/2004 | Sakakibara |
| 6,719,074 | B2 | 4/2004 | Tsuda et al. |
| 6,729,420 | B2 | 5/2004 | Mensa-Wilmot |
| 6,732,817 | B2 | 5/2004 | Dewey et al. |
| 6,732,914 | B2 | 5/2004 | Cadden et al. |
| 6,733,087 | B2 | 5/2004 | Hall et al. |
| 6,739,327 | B2 | 5/2004 | Sollami |
| 6,749,033 | B2 | 6/2004 | Griffin et al. |
| 6,758,530 | B2 | 7/2004 | Sollami |
| D494,031 | S | 8/2004 | Moore, Jr. |
| D494,064 | S | 8/2004 | Hook |
| 6,786,557 | B2 | 9/2004 | Montgomery, Jr. |
| 6,802,676 | B2 | 10/2004 | Noggle |
| 6,822,579 | B2 | 11/2004 | Goswami et al. |
| 6,824,225 | B2 | 11/2004 | Stiffler |
| 6,846,045 | B2 | 1/2005 | Sollami |
| 6,851,758 | B2 | 2/2005 | Beach |
| 6,854,810 | B2 | 2/2005 | Montgomery, Jr. |
| 6,861,137 | B2 | 3/2005 | Hughes et al. |
| 6,863,352 | B2 | 3/2005 | Sollami |
| 6,878,447 | B2 | 4/2005 | Griffin et al. |
| 6,879,947 | B1 | 4/2005 | Glass |
| 6,880,744 | B2 | 4/2005 | Noro et al. |
| 6,889,890 | B2 | 5/2005 | Yamazaki et al. |
| 6,918,636 | B2 | 7/2005 | Dawood |
| 6,929,076 | B2 | 8/2005 | Fanuel et al. |
| 6,933,049 | B2 | 8/2005 | Wan et al. |
| 6,938,961 | B2 | 9/2005 | Broom |
| 6,953,096 | B2 | 10/2005 | Gledhill et al. |
| 6,959,765 | B2 | 11/2005 | Bell |
| 6,962,395 | B2 | 11/2005 | Mouthaan |
| 6,966,611 | B1 | 11/2005 | Sollami |
| 6,994,404 | B1 | 2/2006 | Sollami |
| 7,048,081 | B2 | 5/2006 | Smith et al. |
| 7,094,473 | B2 | 8/2006 | Takayama et al. |
| 7,097,258 | B2 | 8/2006 | Sollami |
| 7,104,344 | B2 | 9/2006 | Kriesels et al. |
| 7,152,703 | B2 | 12/2006 | Meiners et al. |
| 7,204,560 | B2 | 4/2007 | Mercier et al. |
| 7,207,398 | B2 | 4/2007 | Runia et al. |
| 7,234,782 | B2 | 6/2007 | Stehney |
| D547,652 | S | 7/2007 | Kerman et al. |
| D560,699 | S | 1/2008 | Omi et al. |
| 7,320,505 | B1 | 1/2008 | Hall et al. |

(56) References Cited

U.S. PATENT DOCUMENTS

| | | | |
|---|---|---|---|
| 7,338,135 | B1 | 3/2008 | Hall et al. |
| 7,350,601 | B2 | 4/2008 | Belnap et al. |
| 7,377,341 | B2 | 5/2008 | Middlemiss et al. |
| 7,380,888 | B2 | 6/2008 | Ojanen |
| 7,384,105 | B2 | 6/2008 | Hall et al. |
| 7,387,345 | B2 | 6/2008 | Hall et al. |
| 7,396,086 | B1 | 7/2008 | Hall et al. |
| 7,413,256 | B2 | 8/2008 | Hall et al. |
| 7,445,294 | B2 | 11/2008 | Hall et al. |
| 7,469,971 | B2 | 12/2008 | Hall et al. |
| 7,469,972 | B2 | 12/2008 | Hall et al. |
| 7,475,948 | B2 | 1/2009 | Hall et al. |
| 7,543,662 | B2 | 6/2009 | Belnap et al. |
| 7,575,425 | B2 | 8/2009 | Hall et al. |
| 7,592,077 | B2 | 9/2009 | Gates, Jr. et al. |
| 7,647,992 | B2 | 1/2010 | Fang et al. |
| 7,665,552 | B2 | 2/2010 | Hall et al. |
| 7,669,938 | B2 | 3/2010 | Hall et al. |
| 7,693,695 | B2 | 4/2010 | Huang et al. |
| 7,703,559 | B2 | 4/2010 | Shen et al. |
| 7,730,977 | B2 | 6/2010 | Achilles |
| 7,757,785 | B2 | 7/2010 | Zhang et al. |
| 7,798,258 | B2 | 9/2010 | Singh et al. |
| 7,997,661 | B2 | 8/2011 | Hall et al. |
| 8,122,980 | B2 | 2/2012 | Hall et al. |
| 8,567,532 | B2 | 10/2013 | Hall et al. |
| 8,590,644 | B2 | 11/2013 | Hall et al. |
| 8,622,155 | B2 | 1/2014 | Hall et al. |
| 8,794,356 | B2 | 8/2014 | Lyons et al. |
| 9,051,795 | B2 * | 6/2015 | Hall ..... E21B 10/5735 |
| 2001/0004946 | A1 | 6/2001 | Jensen |
| 2001/0040053 | A1 | 11/2001 | Beuershausen |
| 2002/0070602 | A1 | 6/2002 | Sollami |
| 2002/0074851 | A1 | 6/2002 | Montgomery |
| 2002/0153175 | A1 | 10/2002 | Ojanen |
| 2002/0175555 | A1 | 11/2002 | Mercier |
| 2003/0044800 | A1 | 3/2003 | Connelly et al. |
| 2003/0079565 | A1 | 5/2003 | Liang et al. |
| 2003/0137185 | A1 | 7/2003 | Sollami |
| 2003/0140360 | A1 | 7/2003 | Mansuy et al. |
| 2003/0141350 | A1 | 7/2003 | Noro et al. |
| 2003/0141753 | A1 | 7/2003 | Peay et al. |
| 2003/0209366 | A1 | 11/2003 | McAlvain |
| 2003/0213621 | A1 | 11/2003 | Britten et al. |
| 2003/0217869 | A1 | 11/2003 | Snyder et al. |
| 2003/0230926 | A1 | 12/2003 | Mondy et al. |
| 2003/0234280 | A1 | 12/2003 | Cadden et al. |
| 2004/0026132 | A1 | 2/2004 | Hall et al. |
| 2004/0026983 | A1 | 2/2004 | McAlvain |
| 2004/0065484 | A1 | 4/2004 | McAlvain |
| 2004/0155096 | A1 | 8/2004 | Zimmerman et al. |
| 2004/0238221 | A1 | 12/2004 | Runia et al. |
| 2004/0256155 | A1 | 12/2004 | Kriesels et al. |
| 2004/0256442 | A1 | 12/2004 | Gates et al. |
| 2005/0035649 | A1 | 2/2005 | Mercier et al. |
| 2005/0044800 | A1 | 3/2005 | Hall et al. |
| 2005/0044987 | A1 | 3/2005 | Takayama et al. |
| 2005/0080595 | A1 | 4/2005 | Huang |
| 2005/0103530 | A1 | 5/2005 | Wheeler et al. |
| 2005/0159840 | A1 | 7/2005 | Lin et al. |
| 2005/0173966 | A1 | 8/2005 | Mouthaan |
| 2005/0263327 | A1 | 12/2005 | Meiners et al. |
| 2006/0032677 | A1 | 2/2006 | Azar et al. |
| 2006/0060391 | A1 | 3/2006 | Eyre et al. |
| 2006/0086537 | A1 | 4/2006 | Dennis |
| 2006/0086540 | A1 | 4/2006 | Griffin et al. |
| 2006/0125306 | A1 | 6/2006 | Sollami |
| 2006/0131075 | A1 | 6/2006 | Cruz |
| 2006/0162969 | A1 | 7/2006 | Belnap et al. |
| 2006/0180354 | A1 | 8/2006 | Belnap et al. |
| 2006/0180356 | A1 | 8/2006 | Durairajan et al. |
| 2006/0186724 | A1 | 8/2006 | Stehney |
| 2006/0237236 | A1 | 10/2006 | Sreshta et al. |
| 2007/0013224 | A1 | 1/2007 | Stehney |
| 2007/0106487 | A1 | 5/2007 | Gavia et al. |
| 2007/0193782 | A1 | 8/2007 | Fang et al. |
| 2007/0221408 | A1 | 9/2007 | Hall et al. |
| 2007/0278017 | A1 | 12/2007 | Shen et al. |
| 2008/0006448 | A1 | 1/2008 | Zhang et al. |
| 2008/0011522 | A1 | 1/2008 | Hall et al. |
| 2008/0053710 | A1 | 3/2008 | Moss |
| 2008/0073126 | A1 | 3/2008 | Shen et al. |
| 2008/0073127 | A1 | 3/2008 | Zhan et al. |
| 2008/0142276 | A1 | 6/2008 | Griffo et al. |
| 2008/0156544 | A1 | 7/2008 | Singh et al. |
| 2008/0206576 | A1 | 8/2008 | Qian et al. |
| 2009/0166091 | A1 | 7/2009 | Matthews et al. |
| 2009/0223721 | A1 | 9/2009 | Dourfaye |

FOREIGN PATENT DOCUMENTS

| | | | |
|---|---|---|---|
| DE | 3431888 | A1 | 3/1985 |
| DE | 3500261 | A1 | 7/1986 |
| DE | 3818213 | A1 | 11/1989 |
| DE | 4039217 | A1 | 6/1992 |
| DE | 4210955 | A1 | 10/1993 |
| DE | 19821147 | A1 | 11/1999 |
| DE | 10163717 | C1 | 5/2003 |
| EP | 0295151 | A2 | 12/1988 |
| EP | 0412287 | A2 | 2/1991 |
| EP | 1574309 | A1 | 9/2005 |
| GB | 2004315 | A | 3/1979 |
| GB | 2037223 | A | 7/1980 |
| GB | 2146058 | A | 4/1985 |
| JP | S60145973 | A | 8/1985 |
| JP | 5280273 | A | 10/1993 |
| JP | 3123193 | B2 | 1/2001 |
| JP | 2002081524 | | 3/2002 |
| RU | 2263212 | C1 | 10/2005 |
| WO | 9213169 | A1 | 8/1992 |

OTHER PUBLICATIONS

International search report for PCT/US2007/075670, dated Nov. 17, 2008.

Chaturvedi et al., Diffusion Brazing of Cast Inconel 738 Superalloy, Sep. 2005, Journal of Materials Online (http//www.azom.com/details.asp?ArticleID=2995), 12 pages.

International Report on Patentability Chapter 1 for PCT/US07/75670, completed Feb. 17, 2009 (6 pages).

International Preliminary Report on Patentability Chapter II for PCT/US2007/075670, completed Aug. 24, 2009 (4 pages).

Durrand, et al., Super-hard, Thick, Shaped PDC Cutters for Hard Rock Drilling: Development and Test Results, pp. 1-8, Feb. 3, 2010, Geothermal Reservoir Engineering, Stanford, CA.

Glowka et al., Progress in the Advanced Synthetic-Diamond Drill Bit Program, 1995, pp. 1-9.

Hoch, G. Jeffrey, Is There Room for Geothermal Energy, Innovation: America's Journal of Technology Communication, Dec. 2006/Jan. 2007, pp. 1-3, web print at http://www.innovation-america.org/archive.php? articleID=215.

Jennejohn, Dan, Research and Development in Geothermal Exploration and Drilling, Dec. 2009, pp. 5, 18-19, Geothermal Energy Association, Washington, D.C.

Taylor, Mark A., The State of Geothermal Technology, Part 1: Subsurface Technology, Nov. 2007, pp. 29-30, Geothermal Energy Association for the US Department of Energy, Washington, DC.

US Department of Energy, Geothermal Drilling, Faster and Cheaper is Better, Geothermal Today, May 2000, p. 28, National Technology Information Service, Springfield, VA.

Kennametal Inc. Catalog entitled "Construction Tools", 1997 pp. 1-20.

Search Report issued in related European Application No. 07873780.6, mailed Jun. 3, 2014 (7 pages).

* cited by examiner

DOWNHOLE DRILL BIT

CROSS REFERENCE TO RELATED APPLICATIONS

This application is a continuation of U.S. patent application Ser. No. 14/089,385, filed on Nov. 25, 2013, which is a continuation of U.S. Pat. No. 8,590,644, filed on Sep. 26, 2007, which is a continuation in part of U.S. Pat. No. 8,622,155, filed on Jul. 27, 2007, which is a continuation in part of U.S. Pat. No. 8,122,980, filed on Jun. 22, 2007. U.S. Pat. No. 8,590,644 is also a continuation in part of U.S. Pat. No. 7,669,938, filed on Jul. 6, 2007, which is a continuation in part of U.S. Pat. No. 7,997,661, filed on Jul. 3, 2007, which is a continuation in part of U.S. patent application Ser. No. 11/766,903, now abandoned, which was filed on Jun. 22, 2007, which is continuation of U.S. patent application Ser. No. 11/766,865, now abandoned, filed on Jun. 22, 2007, which is a continuation in part of U.S. Pat. No. 7,475,948, filed on Apr. 30, 2007, which is a continuation of U.S. Pat. No. 7,469,971, which is a continuation in part of U.S. Pat. No. 7,338,135, filed on Aug. 11, 2006, which is a continuation in part of U.S. Pat. No. 7,384,105, filed on Aug. 11, 2006, which is a continuation in part of U.S. Pat. No. 7,320,505, filed on Aug. 11, 2006, which is a continuation in part of U.S. Pat. No. 7,445,294, filed on Aug. 11, 2006, which is a continuation in part of U.S. Pat. No. 7,413,256, filed on Aug. 11, 2006. U.S. Pat. No. 8,590,644 is also a continuation in part of U.S. Pat. No. 7,396,086, filed on Apr. 3, 2007, which is a continuation in part of U.S. Pat. No. 7,568,770, filed on Mar. 16, 2007.

BACKGROUND

This invention relates to drill bits, specifically drill bit assemblies for use in oil, gas and geothermal drilling. More particularly, the invention relates to cutting elements in rotary drag bits comprised of a carbide substrate with a non-planar interface and an abrasion resistant layer of superhard material affixed thereto using a high pressure high temperature (HPHT) press apparatus. Such cutting elements typically comprise a superhard material layer or layers formed under high temperature and pressure conditions, usually in a press apparatus designed to create such conditions, cemented to a carbide substrate containing a metal binder or catalyst such as cobalt. A cutting element or insert is normally fabricated by placing a cemented carbide substrate into a container or cartridge with a layer of diamond crystals or grains loaded into the cartridge adjacent one face of the substrate. A number of such cartridges are typically loaded into a reaction cell and placed in the HPHT apparatus. The substrates and adjacent diamond crystal layers are then compressed under HPHT conditions which promotes a sintering of the diamond grains to form the polycrystalline diamond structure. As a result, the diamond grains become mutually bonded to form a diamond layer over the substrate interface. The diamond layer is also bonded to the substrate interface.

Such cutting elements are often subjected to intense forces, torques, vibration, high temperatures and temperature differentials during operation. As a result, stresses within the structure may begin to form. Drag bits for example may exhibit stresses aggravated by drilling anomalies during well boring operations such as bit whirl or bounce often resulting in spalling, delamination or fracture of the superhard abrasive layer or the substrate thereby reducing or eliminating the cutting elements efficacy and decreasing overall drill bit wear life. The superhard material layer of a cutting element sometimes delaminates from the carbide substrate after the sintering process as well as during percussive and abrasive use. Damage typically found in drag bits may be a result of shear failures, although non-shear modes of failure are not uncommon. The interface between the superhard material layer and substrate is particularly susceptible to non-shear failure modes due to inherent residual stresses.

U.S. Pat. No. 6,332,503 to Pessier et al., which is herein incorporated by reference for all that it contains, discloses an array of chisel-shaped cutting elements mounted to the face of a fixed cutter bit, each cutting element has a crest and an axis which is inclined relative to the borehole bottom. The chisel-shaped cutting elements may be arranged on a selected portion of the bit, such as the center of the bit, or across the entire cutting surface. In addition, the crest on the cutting elements may be oriented generally parallel or perpendicular to the borehole bottom.

U.S. Pat. No. 6,059,054 to Portwood et al., which is herein incorporated by reference fir all that it contains, discloses a cutter element that balances maximum gage-keeping capabilities with minimal tensile stress induced damage to the cutter elements is disclosed. The cutter elements of the present invention have a nonsymmetrical shape and may include a more aggressive cutting profile than conventional cutter elements. In one embodiment, a cutter element is configured such that the inside angle at which its leading face intersects the wear face is less than the inside angle at which its trailing face intersects the wear face. This can also be accomplished by providing the cutter element with a relieved wear face. In another embodiment of the invention, the surfaces of the present cutter element are curvilinear and the transitions between the leading and trailing faces and the gage face are rounded, or contoured. In this embodiment, the leading transition is made sharper than the trailing transition by configuring it such that the leading transition has a smaller radius of curvature than the radius of curvature of the trailing transition. In another embodiment, the cutter element has a chamfered trailing edge such that the leading transition of the cutter element is sharper than its trailing transition. In another embodiment, the cutter element has a chamfered or contoured trailing edge in combination with a canted wear face. In still another embodiment, the cutter element includes a positive rake angle on its leading edge.

SUMMARY

In one aspect, a drill bit has a body intermediate a shank and a working face. The working face has a plurality of blades converging towards a center of the working face and diverging towards a gauge of the working face. A first blade has at least one pointed cutting element with a carbide substrate bonded to a diamond working end with a pointed geometry at a non-planar interface and a second blade has at least one shear cutting element with a carbide substrate bonded to a diamond working end with a flat geometry.

The carbide substrate bonded to the pointed geometry diamond working may have a tapered geometry. A plurality of first blades having the at least one pointed cutting element may alternate with a plurality of second blades having the at least one shear cutting element. A plurality of cutting elements may be arrayed along any portion of their respective blades including a cone portion, nose portion, flank portion, gauge portion, or combinations thereof. When the first and second blades are superimposed on each other, an axis of the at least one pointed cutting element may be offset from an axis of the at least one shear cutting element. An apex of the pointed cutting element may have a 0.050 to 0.200 inch radius. The diamond working en of the pointed cutting element may have a 0.090 to 0.500 inch thickness from the apex to the non-planar interface. A central axis of the pointed cutting element may be tangent to its intended cutting path during a downhole drilling operation. In other embodiments, the central axis of the pointed cutting element may be positioned at an angle relative to its intended cutting path during a downhole drilling operation. The angle of the at least one pointed cutting element on the first blade may be offset from an angle of the at least one shear cutting element on the second blade. A pointed cutting element on the first blade may be oriented at a different angle than an adjacent pointed cutting element on the same blade. The pointed cutting element and the shear cutting element may have different rake angles. The pointed cutting element may generally comprise a smaller rake angle than the shear cutting element. A first pointed cutting element may be located further from the center of the working face than a first shear cutting element. The carbide substrate of the pointed cutting element may be disposed within the first blade. The non-planar interface of the shear cutting element may comprise at least two circumferentially adjacent faces, outwardly angled from a central axis of the substrate.

DETAILED DESCRIPTION

Figure 1:
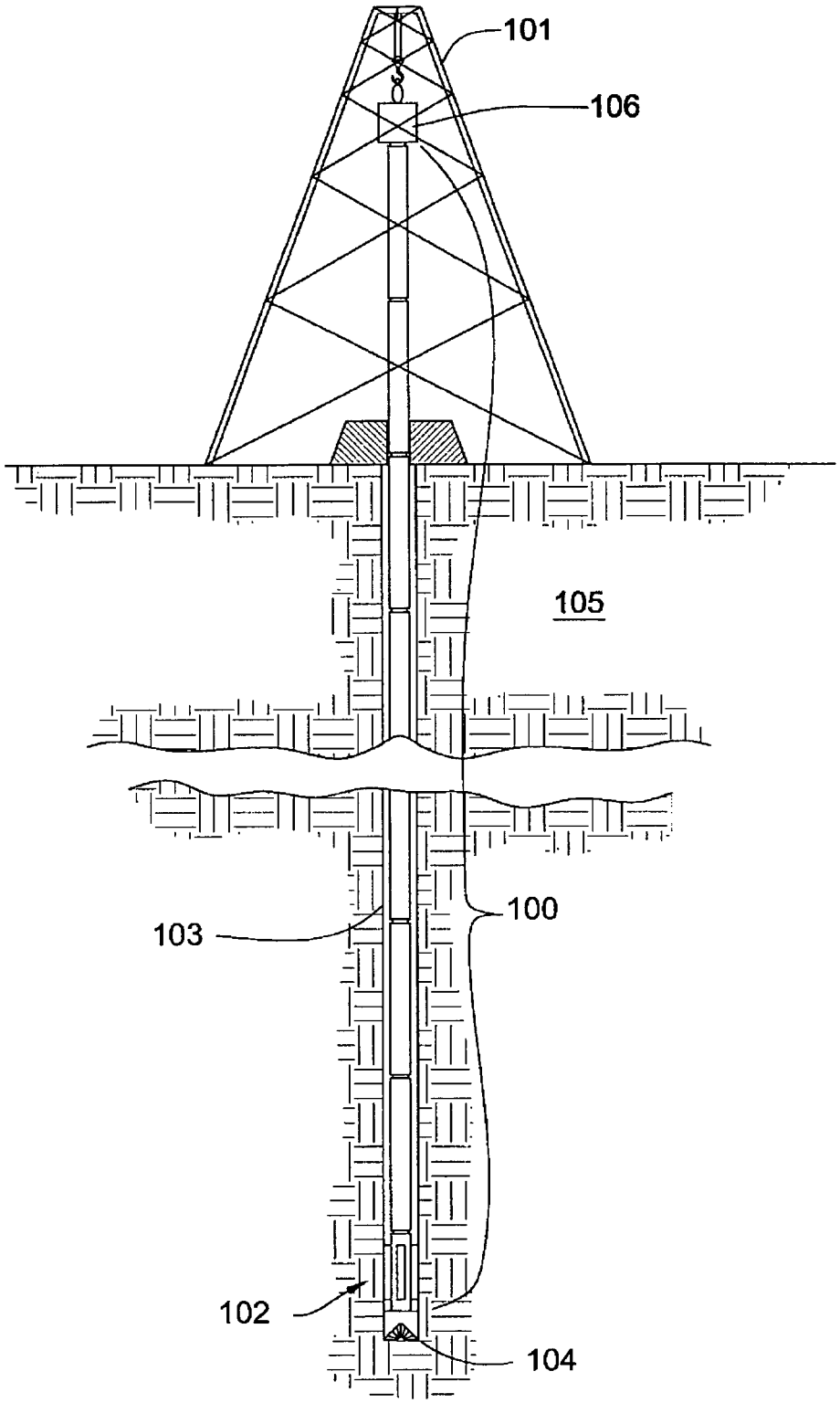
FIG. 1 is a perspective diagram of an embodiment of a drill string suspended in a wellbore.

FIG. 1 is a perspective diagram of an embodiment of a drill string 100 suspended by a derrick 101. A bottom-hole assembly 102 is located at the bottom of a wellbore 103 and comprises a drill bit 104. As the drill bit 104 rotates downhole the drill string 100 advances farther into the earth. The drill string 100 may penetrate soft or hard subterranean formations 105. The drill bit 104 may break up the formations 105 by cutting and/or chipping the formation 105 during a downhole drilling operation. The bottom-hole assembly 102 and/or downhole components may comprise data acquisition devices which may gather data. The data may be sent to the surface via a transmission system to a data swivel 106. The data swivel 106 may send the data to the surface equipment. Further, the surface equipment may send data and/or power to downhole tools and/or the bottom-hole assembly 102. U.S. Pat. No. 6,670,880 which is herein incorporated by reference for all that it contains, discloses a telemetry system that may be compatible with the present invention; however, other forms of telemetry may also be compatible such as systems that include mud pulse systems, electromagnetic waves, radio waves, and/or short hop. In some embodiments, no telemetry system is incorporated into the drill string.

Figure 2:
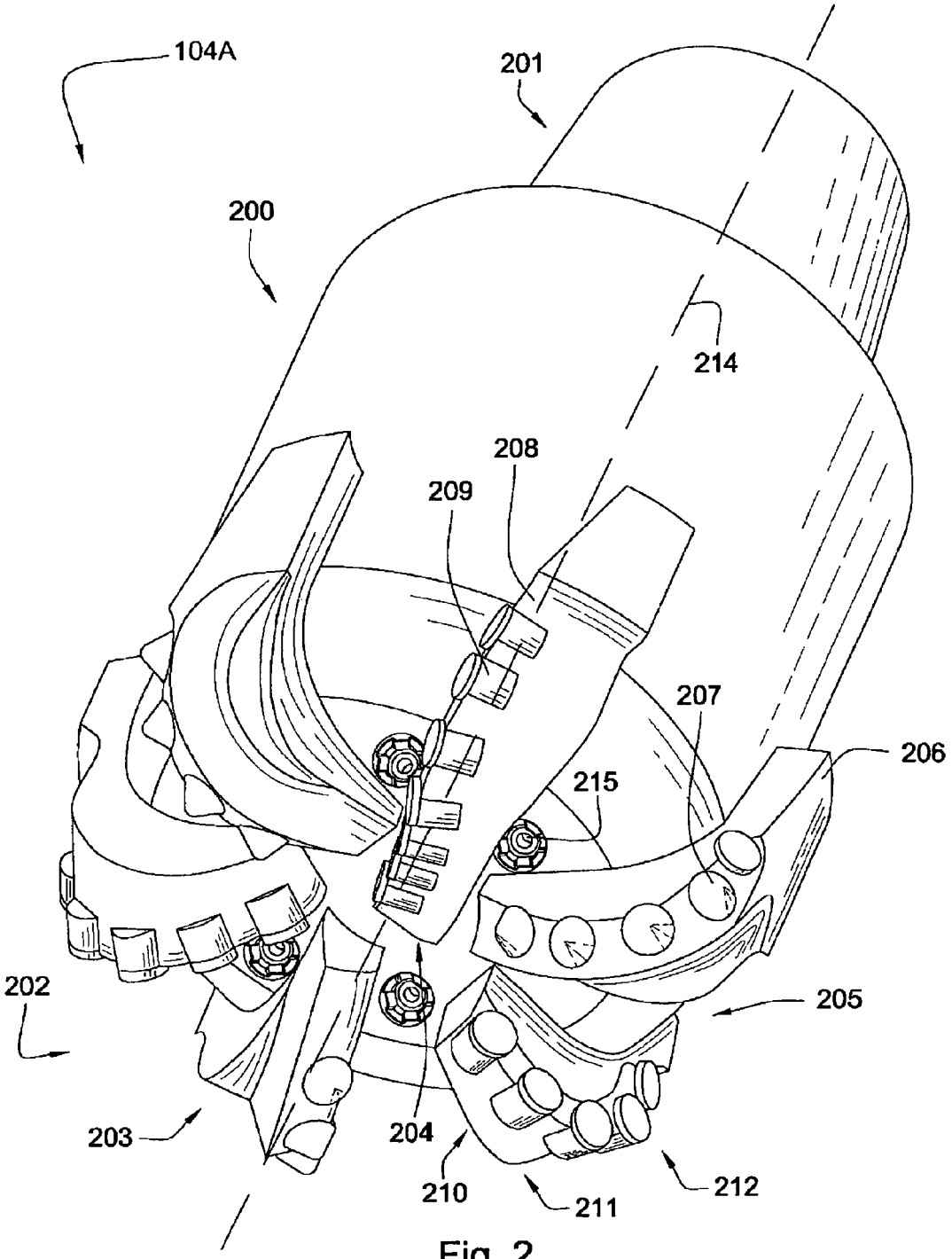
FIG. 2 is a perspective diagram of an embodiment of a drill bit.

In the embodiment of FIG. 2, the drill bit 104A has a body 200 intermediate a shank 201 and a working face 202; the working face 202 having a plurality of blades 203 converging towards a center 204 of the working face 202 and diverging towards a gauge portion 205 of the working face 202. A first blade 206 may have at least one pointed cutting element 207 and a second blade 208 may have at least one shear cutting element 209. In the preferred embodiment, a plurality of first blades 206 having the at least one pointed cutting element 207 may alternate with a plurality of second blades 208 having the at least one shear cutting element 209. A carbide substrate of the pointed cutting element 207 may be disposed within the first blade 206.

Also in this embodiment, a plurality of cutting elements 207, 209, may be arrayed along any portion of their respective blades 206, 208, including a cone portion 210, nose portion 211, flank portion 212, gauge portion 205, or combinations thereof.

Also shown in FIG. 2, a plurality of nozzles 215 may be disposed into recesses formed in the working face 202. Each nozzle 215 may be oriented such that a jet of drilling mud ejected from the nozzles 215 engages the formation before or after the cutting elements 207, 209. The jets of drilling mud may also be used to clean cuttings away from the drill bit 104. The drill bit 104A may be intended for deep oil and gas drilling, although any type of drilling application is anticipated such as horizontal drilling, geothermal drilling, exploration, on and off-shore drilling, directional drilling, water well drilling and any combination thereof.

Figure 3:
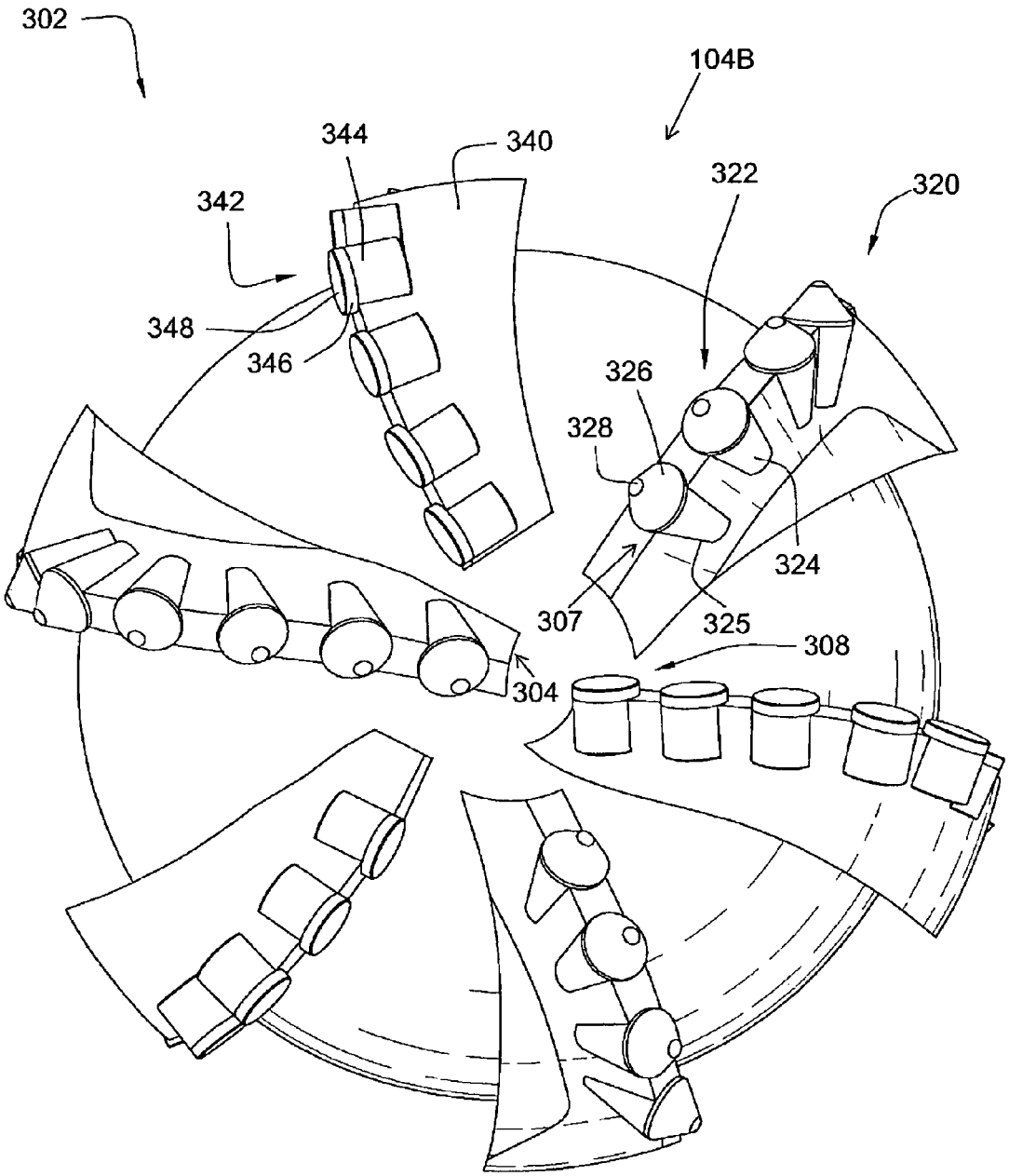
FIG. 3 is an orthogonal diagram of another embodiment of a drill bit.

Referring now to another embodiment of the drill bit 104B illustrated in FIG. 3, the first blade 320 comprises at least one pointed cutting element 322 with a first carbide substrate 324 bonded to a diamond working end 326 with a pointed geometry 328. The second blade 340 comprises at least one shear cutting element 342 with a second carbide substrate 344 bonded to a diamond working end 346 with a flat geometry 348. The first carbide substrate 324 bonded to the pointed geometry diamond working end 326 may have a tapered geometry 325. In this embodiment, a first pointed cutting element 307 may be farther from the center 304 of the working face 302 than a first shear cutting element 308.

Figure 4:
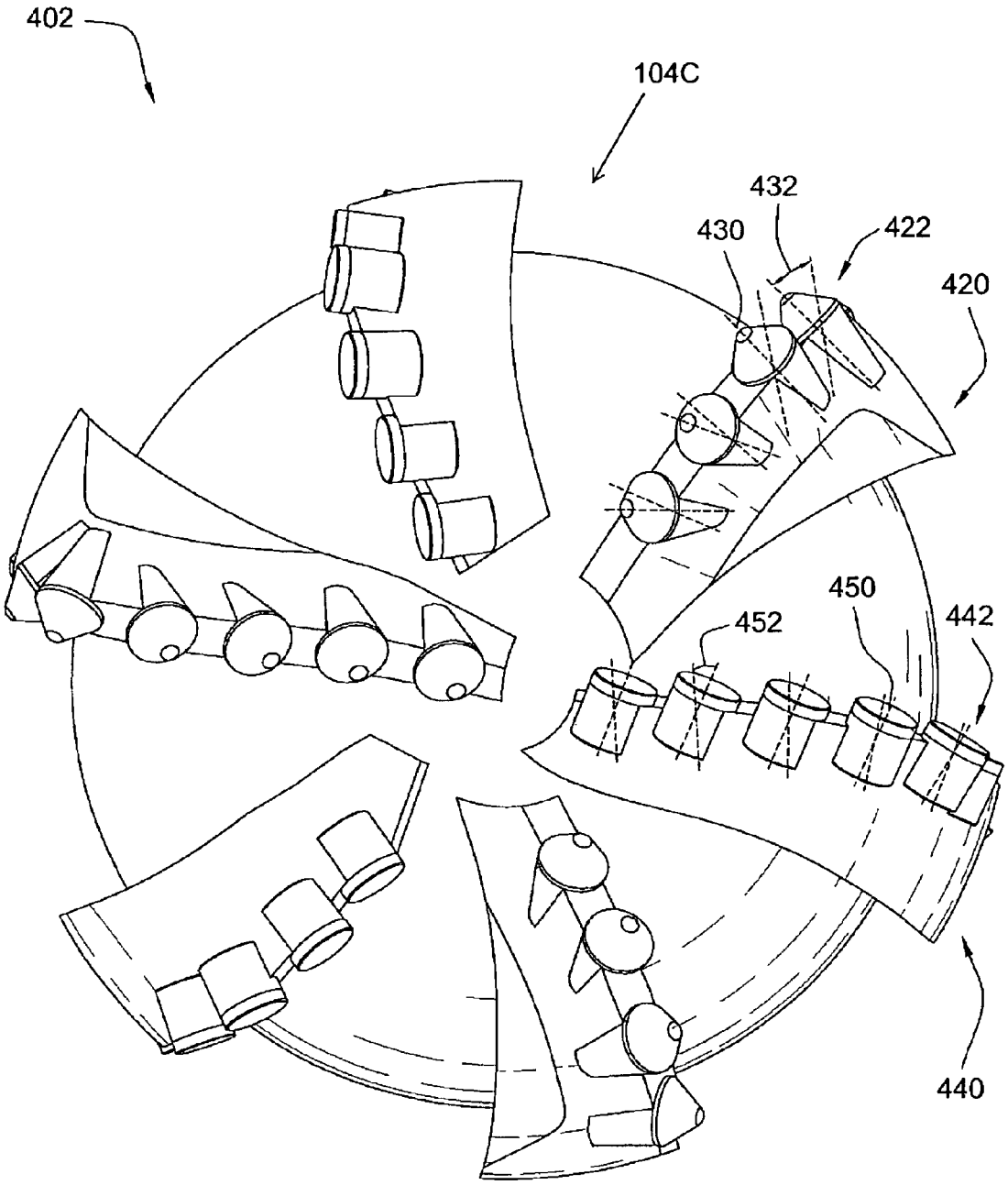
FIG. 4 is an orthogonal diagram of another embodiment of a drill bit.

Referring now to another embodiment of the drill bit 104C illustrated in FIG. 4, a central axis 430 of the pointed cutting element 422 may be positioned at an angle 432 (e.g. side rake, as known to one of skill in the art) relative to a cutting path formed by the working face 402 of the drill bit during a downhole drilling operation. Furthermore, the angle 432 (or side rake) of at least one pointed cutting element 422 on the first blade 420 may be offset from an angle 452 (or side rake) of at least one shear cutting element 442 on the second blade 440 having a central axis 450 positioned at the angle 452 relative to a cutting path. This orientation may be beneficial in that one blade having all its cutting elements at a common angle relative to a cutting path may offset cutting elements on another blade having another common angle. This may result in a more efficient drilling operation.

Figure 5:
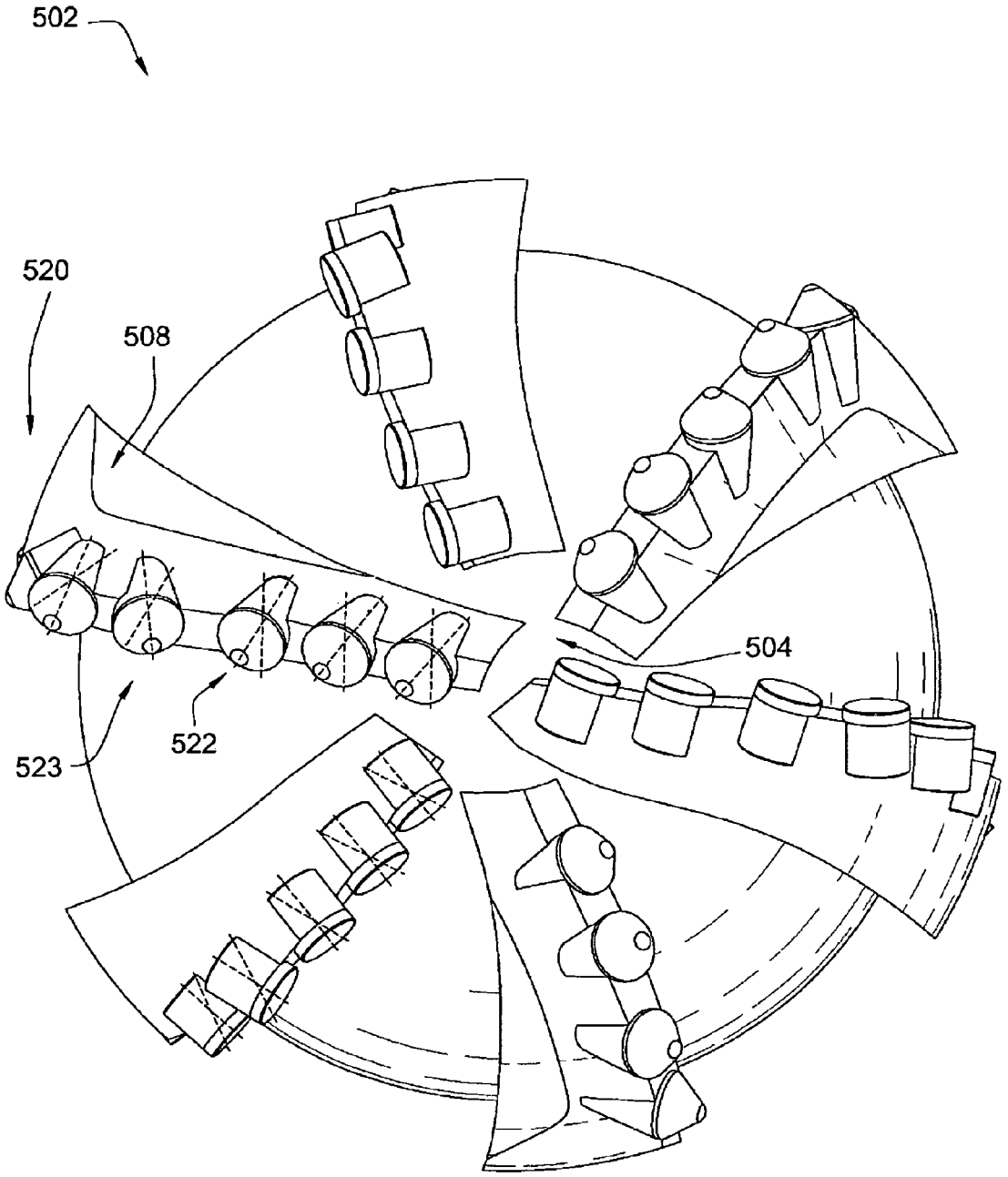
FIG. 5 is an orthogonal diagram of another embodiment of a drill bit.

In the embodiment of the drill bit 104D shown in FIG. 5, the pointed cutting element 522 on the first blade 520 may be oriented at a different angle (side rake) than an adjacent pointed cutting element 523 on the same blade 520. In this embodiment, the pointed cutting elements 522 on the blade 520 nearest the center 504 of the working face 502 may be angled away from a center of the intended circular cutting path, while the pointed cutting elements 523 nearest the gauge portion 508 of the working face 502 may be angled toward the center of the cutting path. This may be beneficial in that cuttings may be forced away from the center 504 of the working face 502 and thereby may be more easily carried to the top of the wellbore.

Figure 6:
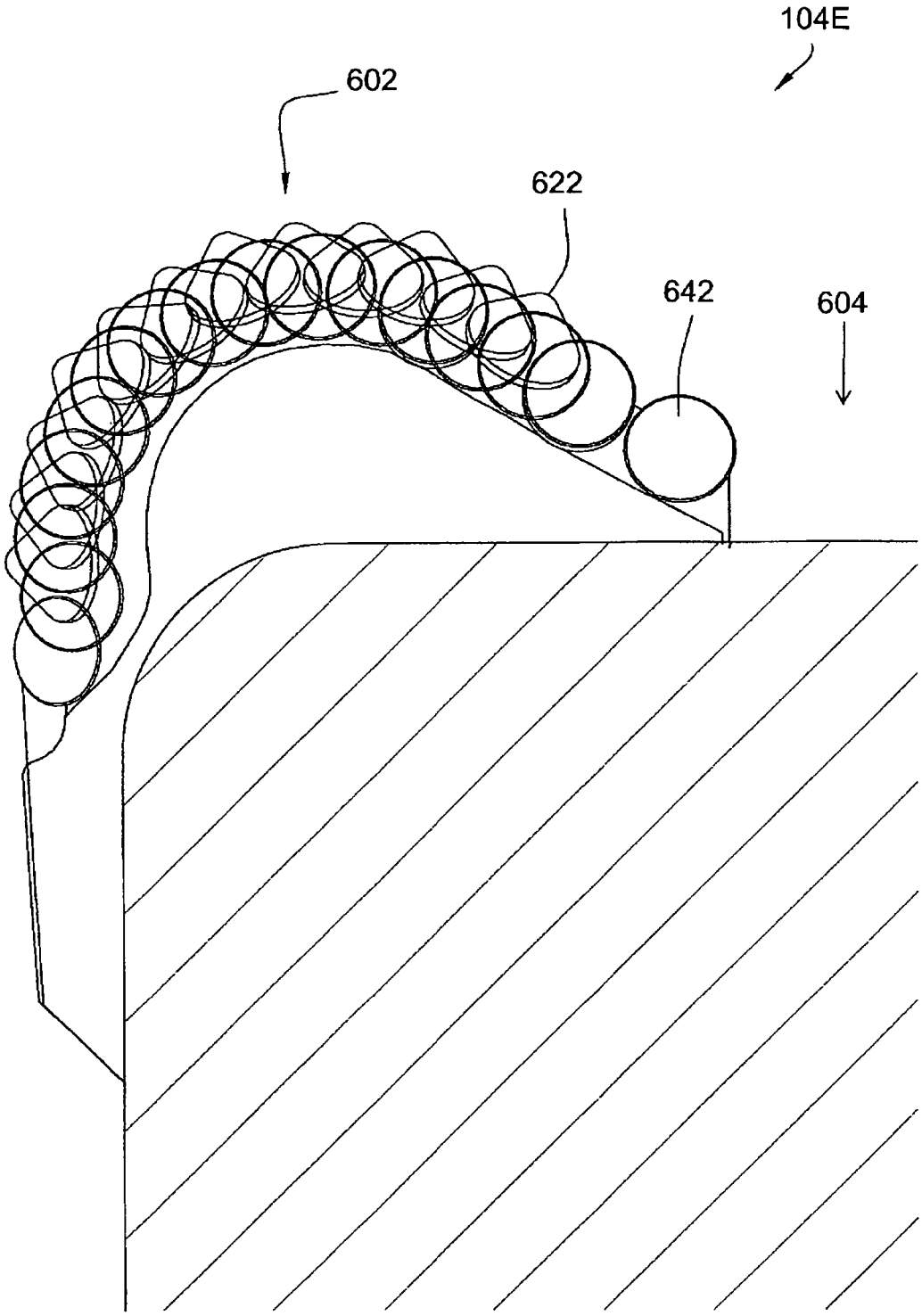
FIG. 6 is a sectional side diagram of an embodiment of a drill bit with a plurality of blades superimposed on one another.

FIG. 6 is a schematic drawing illustrating one embodiment of the drill bit 104E having the plurality of blades graphically superimposed on one another. A plurality of pointed cutting elements 622 on a first blade and a plurality of shear cutting elements 642 on a second blade may comprise different intended cutting paths so that the drilling operation may have an increase in efficiency than if the cutting elements had the same cutting paths. Having cutting elements positioned on the blades at different cutting paths, or radially offset from one another, may break up the formation more quickly and efficiently. As shown in this embodiment, the pointed cutting elements on a first blade may also have a different intended cutting path than the pointed cutting elements on another blade. The shear cutting elements on a second blade may also have a different intended cutting path than the shear cutting elements disposed on another blade. In this embodiment, an innermost shear cutting element 642 may be closer to the center 604 of the working face 602 than an innermost pointed cutting element 622.

Figure 7:
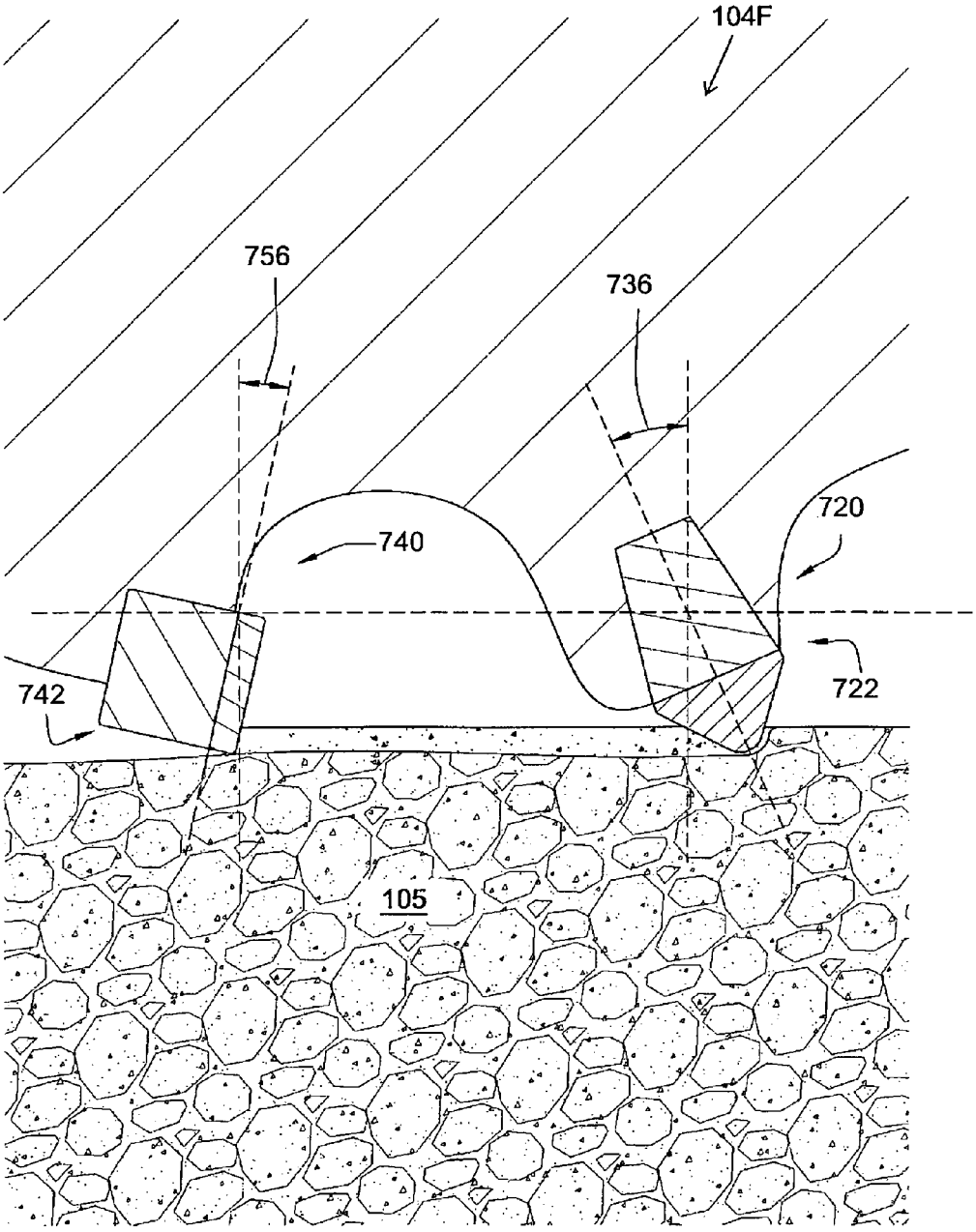
FIG. 7 is a cross-sectional diagram of an embodiment of a plurality of cutting elements positioned on a drill bit.

Referring now to FIG. 7, illustrated therein is another embodiment of the drill bit 104F having a shear cutting element 742 on a second blade 740 orientated at a negative rake angle 756, whereas a pointed cutting element 722 on a first blade 720 is orientated at a positive rake angle 736. It may be beneficial that cutting elements 722, 742 on adjacent blades 720, 740, respectively, have opposite rake angles such that the formation 105 may be more easily cut and removed. In this embodiment, the pointed cutting element 722 may plow through the formation 105 causing the cut formation to build up around the pointed cutting element. The shear cutting element 742, being radially offset from the pointed cutting element 722, may then easily remove the built up formation.

Figure 8:
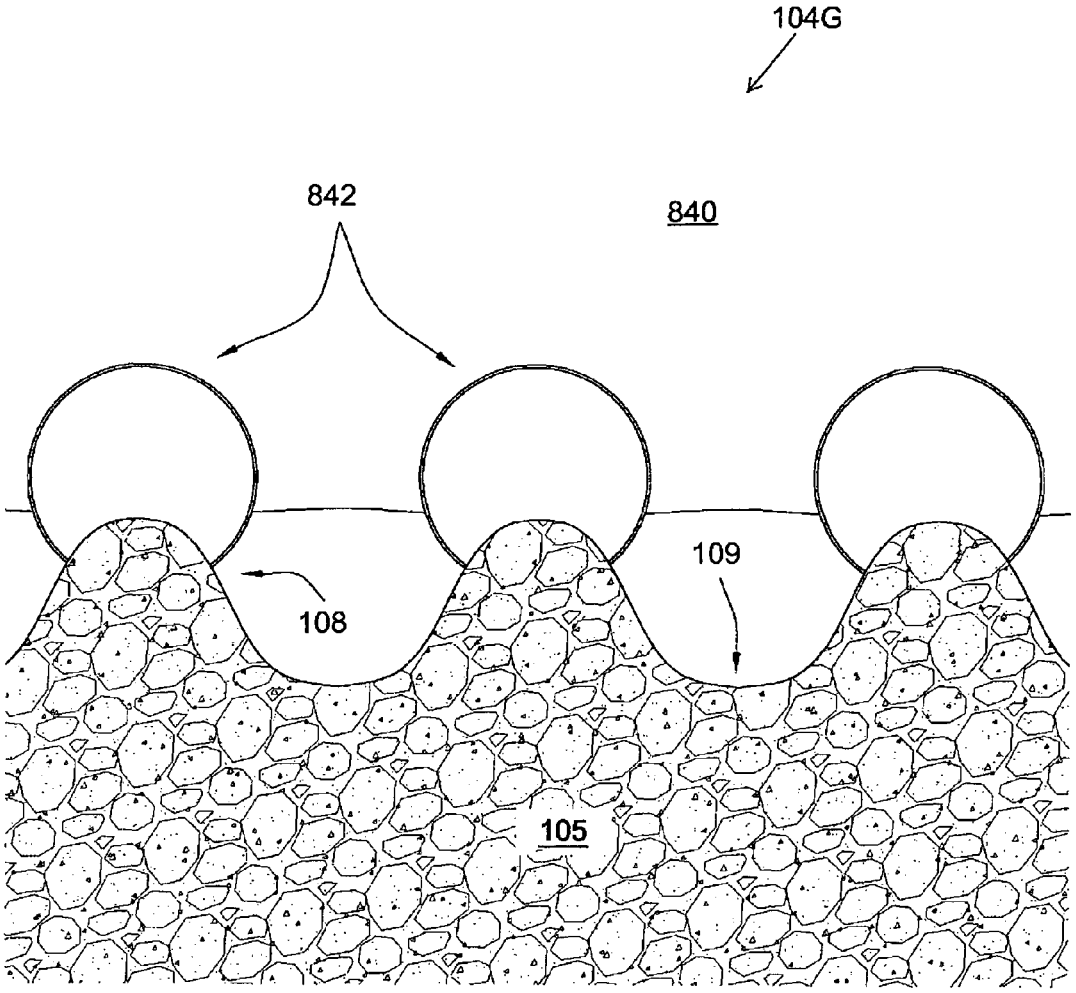
FIG. 8 is a cross-sectional diagram of another embodiment of a plurality of cutting elements positioned on a drill bit.

In the embodiment of the drill bit 104G illustrated in FIG. 8, a plurality of shear cutting elements 842 may be positioned on a second blade 840 such that as the drill bit rotates and its blades follow an intended cutting path, the shear cutting elements 842 may remove mounds of the formation 105 formed by a plurality of pointed cutting elements on an adjacent blade; the pointed cutting elements having plowed through a relatively soft formation 105 forming mounds 108 and valleys 109 during a drilling operation. This may be beneficial so that the formation may be evenly cut and removed downhole. It is believe that in harder formations, the pointed cutting elements will fracture the rock verses displacing it into mounds.

Figure 9:
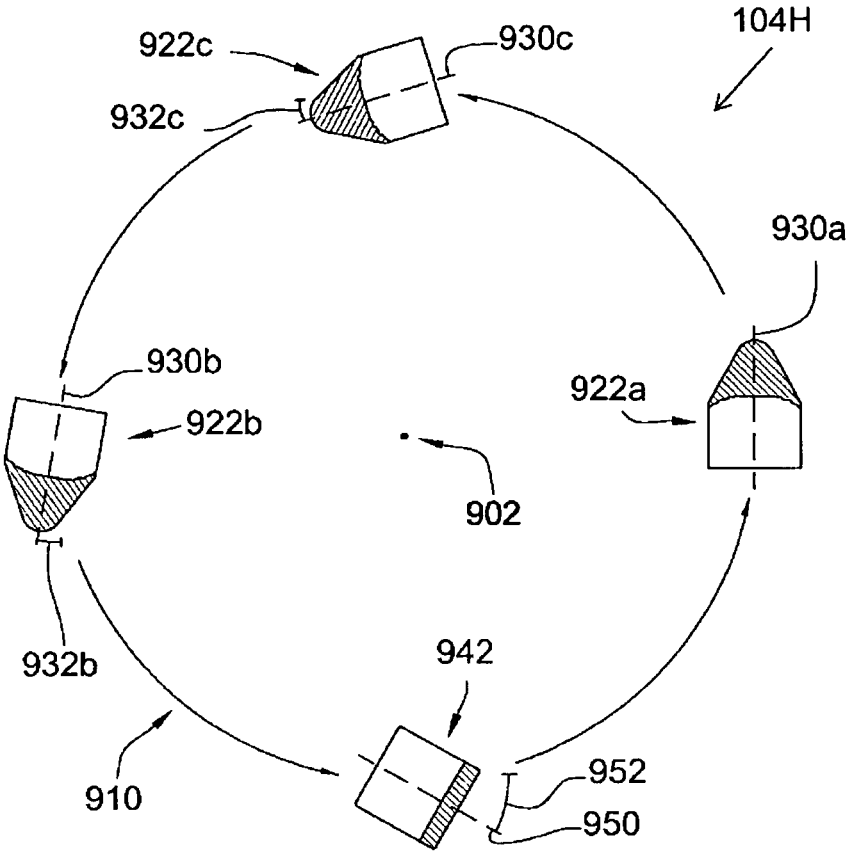
FIG. 9 is a representation of an embodiment pattern of a cutting element.

Referencing yet another representative embodiment of the drill bill 104H, FIG. 9 illustrates a central axis 930*a* of a pointed cutting element 922*a* tangent to an intended cutting path 910 formed by the working face of the drill bit during a downhole drilling operation. The central axis 930*b* of another pointed cutting element 922*b* may be angled away from a center 902 of the cutting path 910. The central axis 930*b* of the angled pointed cutting element 922*b* may form a smaller angle 932*b* with the cutting path 910 than an angle 952 formed by the central axis 920 and the cutting path 910 of an angled shear cutting element 942. In other embodiments, the central axis 930*c* of another pointed cutting element 922*c* may form an angle 932*c* with the cutting path 910 such that the cutting element 922*c* angles towards the center 902 of the cutting path 910.

Figure 10:
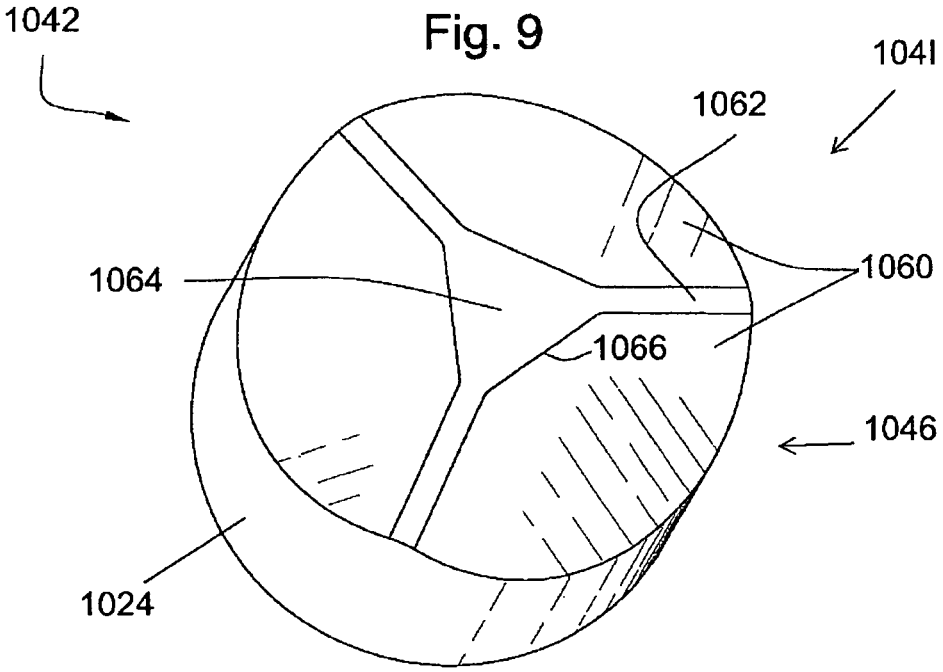
FIG. 10 is a perspective diagram of an embodiment of a carbide substrate.

In the embodiment 1041 of FIG. 10, the non-planar interface of a shear cutting element 1042 may have a diamond working end 1046 including at least two circumferentially adjacent diamond working surfaces 1060, each angled outwardly and downwardly from a central axis of the second carbide substrate 1044. In this embodiment, the carbide substrate 1044 may comprise a junction 1062 between adjacent working surfaces 1060; the junction 1062 having a radius of 0.060 to 0.140 inch. Another junction 1066 between a flatted portion 1064 and each working surface 1060 may comprise a radius of 0.055 to 0.085 inch. When the shear cutting element 1042 is worn, it may be removed from the blade of the drill bit (not shown), rotated, re-attached such that another working surface 1060 is presented to the formation. This may allow for the bit to continue degrading the formation and effectively increase its working life. In this embodiment, the working surfaces 1060 may have equal areas. However, in other embodiments the working surfaces may comprise different areas.

Figure 11:
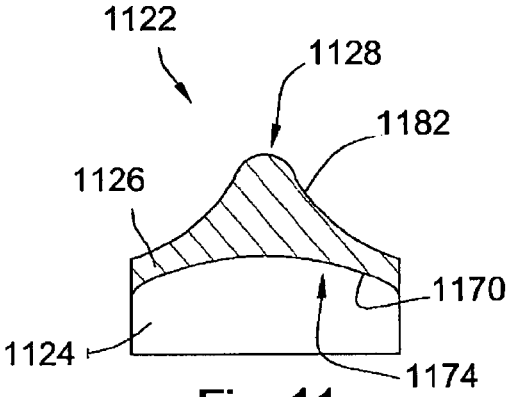
FIG. 11 is a cross-sectional diagram of an embodiment of a pointed cutting element.

FIGS. 11 through 18 show various embodiments of a pointed cutting element with a diamond working end bonded to a carbide substrate, and with the diamond working end having a tapered outer surface and a pointed geometry. For example, FIG. 11 illustrates a pointed cutting element 1122 with a pointed geometry 1128 having a concave outer surface 1182 and a continuous convex geometry 1172 at an interface 1170 between the substrate 1124 and the diamond working end 1126.

Figure 12:
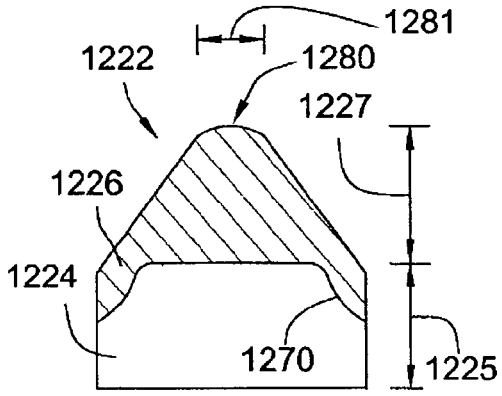
FIG. 12 is a cross-sectional diagram of another embodiment of a pointed cutting element.

FIG. 12 comprises an embodiment of a thicker diamond working end from the apex 1280 to the non-planar interface 1270, while still maintaining a radius 1281 of 0.050 to 0.200 inch. The diamond working end 1226 may comprise a thickness 1227 of 0.050 to 0.500 inch. The carbide substrate 1224 may comprise a thickness 1225 of 0.200 to 1 inch from a base of the carbide substrate to the non-planar interface 1270.

Figure 13:
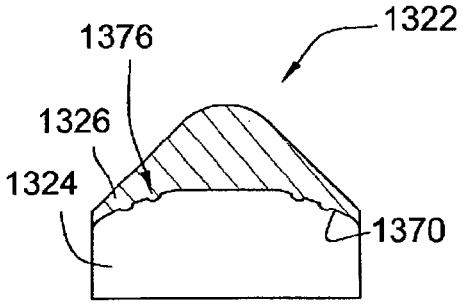
FIG. 13 is a cross-sectional diagram of another embodiment of a pointed cutting element.

FIG. 13 illustrates grooves 1376 formed in the substrate 1324. It is believed that the grooves 1376 may help to increase the strength of the pointed cutting element 1322 at the interface 1370 between the carbide substrate 1324 and the diamond working end 1326.

Figure 14:
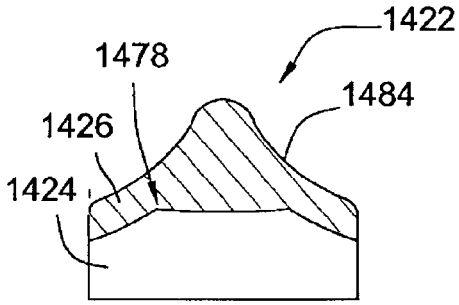
FIG. 14 is a cross-sectional diagram of another embodiment of a pointed cutting element.

FIG. 14 illustrates a pointed cutting element 1422 having a slightly concave geometry 1478 at the interface 1470 between the carbide substrate 1424 and the diamond working end 1426, and with the diamond working end 1426 a concave outer surface 1484.

Figure 15:
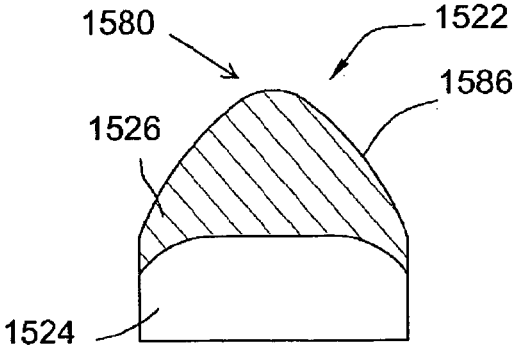
FIG. 15 is a cross-sectional diagram of another embodiment of a pointed cutting element.

FIG. 15 discloses a pointed cutting element 1522 having a diamond working end 1526 with a slightly convex outer surface 1586 of the pointed geometry while still maintaining a 0.050 to 0.200 inch radius at the apex 1580.

Figure 16:
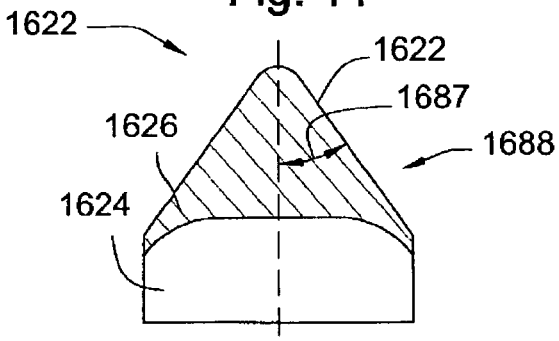
FIG. 16 is a cross-sectional diagram of another embodiment of a pointed cutting element.

FIG. 16 discloses a pointed cutting element 1622 having a diamond working end 1526 having a flat sided pointed geometry 1528. In some embodiments, an outer surface 1688 and a central axis of the diamond working end 1626 may generally form a 35 to 45 degree included angle 1687.

Figure 17:
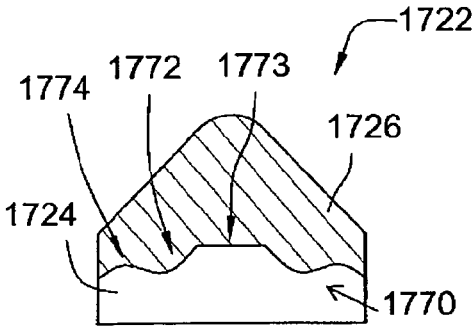
FIG. 17 is a cross-sectional diagram of another embodiment of a pointed cutting element.

FIG. 17 discloses a pointed cutting element 1722 having a interface 1770 between the carbide substrate 1724 and the diamond working end 1726 that includes a concave portion 1774 and a convex portion 1772 and a generally flatted central portion 1773.

Figure 18:
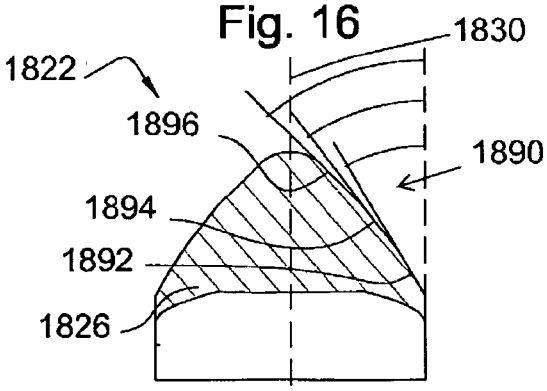
FIG. 18 is a cross-sectional diagram of another embodiment of a pointed cutting element.

In the embodiment of a pointed cutting element 1822 illustrated in FIG. 18, the diamond working end 1826 may have a convex outer surface 1890 comprising different general angles at a lower portion 1892, a middle portion 1894, and an upper portion 1896 with respect to the central axis 1830 of the cutting element. The lower portion 1892 of the side surface 1890 may be angled at substantially 25 to 33 degrees from the central axis 1830, the middle portion 1894, which may make up a majority of the convex surface, may be angled at substantially 22 to 40 degrees from the central axis 1830, and the upper portion 1896 of the side surface may be angled at substantially 40 to 50 degrees from the central axis 1830.

Whereas the present invention has been described in particular relation to the drawings attached hereto, it should be understood that other and further modifications apart from those shown or suggested herein, may be made within the scope and spirit of the present invention.

What is claimed:

1. A downhole cutting tool, comprising:

a tool body;

a plurality of blades extending from the tool body; and a plurality of cutting elements on the plurality of blades, the plurality of cutting elements including at least one pointed cutting element and at least one shear cutting element, the at least one pointed cutting element having a working end opposite a first base, the working end terminating in a substantially pointed geometry opposite the first base;

the at least one shear cutting element comprising a planar cutting surface opposite a second base; and when the plurality of blades are superimposed on each other, a central axis of at least one shear cutting element is radially between a central axis of at least two pointed cutting elements.

2. The downhole cutting tool of claim 1, wherein the at least one pointed cutting element comprises a first polycrystalline diamond material at the working end, the first polycrystalline diamond material having a thickness measured from an outer surface of the pointed cutting element to an interface with a first carbide substrate, the thickness being greatest at an apex of the pointed cutting element.

3. The downhole cutting element of claim 1, wherein the central axis of the at least one pointed cutting element is radially offset from a central axis of the at least one shear cutting element.

4. The downhole cutting element of claim 1, wherein the central axis of the at least one pointed cutting element is angled relative to the central axis of the at least one shear cutting element.

5. The downhole cutting tool of claim 1, wherein the pointed geometry comprises a side wall that tangentially joins an apex having a radius of curvature.

6. The downhole cutting tool of claim 1, wherein the pointed cutting element and the shear cutting element comprise different rake angles.

7. The downhole cutting tool of claim 1, wherein the downhole cutting tool is a fixed cutter drill bit having the plurality of blades extending from a bit body.

8. The downhole cutting tool of claim 1, wherein the at least one pointed cutting element and the at least one shear cutting element are on the same blade.

9. A downhole cutting tool, comprising:

a tool body;

a plurality of blades extending from the tool body; and a plurality of cutting elements on the plurality of blades, the plurality of cutting elements including at least one pointed cutting element and at least one shear cutting element, the at least one pointed cutting element having a working end opposite a first base, the working end terminating in a substantially pointed geometry opposite the first base;

the at least one shear cutting element comprising a planar cutting surface opposite a second base; and when the plurality of blades are superimposed on each other, a central axis of at least one pointed cutting element is radially between a central axis of at least two shear cutting elements.

10. The downhole cutting tool of claim 9, wherein the at least one pointed cutting element comprises a first polycrystalline diamond material at the working end, and the first polycrystalline diamond material has a thickness measured from an outer surface of the pointed cutting element to an interface with a first carbide substrate, the thickness being greatest at an apex of the pointed cutting element.

11. The downhole cutting element of claim 9, wherein the central axis of the at least one pointed cutting element is angled relative to the central axis of the at least one shear cutting element.

12. The downhole cutting tool of claim 9, wherein the substantially pointed geometry comprises a side wall that tangentially joins an apex having a radius of curvature.

13. The downhole cutting tool of claim 9, wherein the pointed cutting element and the shear cutting element comprise different rake angles.

14. The downhole cutting tool of claim 9, wherein the downhole cutting tool is a fixed cutter drill bit having the plurality of blades extending from a bit body.

15. A drill bit comprising:

a shank;

a body attached to the shank, the body including a working face;

the working face including a plurality of blades converging towards a center of the working face and diverging towards a gauge portion of the working face;

a first blade of the plurality of blades including at least one pointed cutting element comprising a working end having a pointed geometry, the at least one pointed cutting element being oriented at a positive rake angle relative to a central axis of the body; and a second blade of the plurality of blades including at least one shear cutting element comprising a working end having a planar surface, the at least one shear cutting element being oriented at a negative rake angle relative to a central axis of the body.

16. The drill bit of claim 15, wherein the first blade is positioned adjacent to the second blade.

17. The drill bit of claim 15, wherein the at least one pointed cutting element comprises a first polycrystalline diamond material, the first polycrystalline diamond material having a thickness measured from an outer surface of the pointed cutting element to an interface with a first carbide substrate, the thickness being greatest at an apex of the pointed cutting element.

18. The drill bit of claim 15, wherein the pointed geometry comprises a side wall that tangentially joins an apex having a radius of curvature.

19. The drill bit of claim 15, wherein the drill bit is a fixed cutter drill bit having the plurality of blades extending from a bit body.

20. The drill bit of claim 15, wherein the central axis of the at least one pointed cutting element is at a radial distance from the central axis of the body different from a radial distance of the at least one shear cutting element.

* * * * *